US006164651A

United States Patent [19]

Webb

[11] Patent Number: 6,164,651

[45] Date of Patent: Dec. 26, 2000

[54] METHOD AND APPARATUS FOR PLAYING A GAME WITH NUMERICAL RESULT

[75] Inventor: Derek J. Webb, Derby, United Kingdom

[73] Assignee: Prime Table Games LLC, Las Vegas, Nev.

[21] Appl. No.: 09/351,330

[22] Filed: Jul. 12, 1999

[51] Int. Cl.[7] ..... A63F 3/08

[52] U.S. Cl. ..... 273/274; 273/236; 273/292; 463/13

[58] Field of Search ..... 273/236, 274, 273/247, 292; 463/12, 13

[56] References Cited

U.S. PATENT DOCUMENTS 4,252,321 2/1981 Hopwood .
5,362,064 11/1994 Lofink .
5,395,119 3/1995 Jacob .
5,529,309 6/1996 Bartlett .

*Primary Examiner*—Mark S. Graham
*Assistant Examiner*—V K Mendiratta
*Attorney, Agent, or Firm*—Nixon & Vanderhye P.C.

[57] ABSTRACT

A Baccarat derivation incorporates multiple betting options while eliminating confusing card-drawing rules, resulting in a more exciting and playable game. A table layout includes betting areas for a competition wager that one side or the other will win the game as well as proposition wager areas that one side or the other will win the game by a particular amount or that the sides will tie with a particular amount. As with conventional Baccarat, the players can wager for either side. The methodology is suited for any game where a result is determined according to numerical values such as Baccarat, Blackjack, War or Dice.

17 Claims, 2 Drawing Sheets

METHOD AND APPARATUS FOR PLAYING A GAME WITH NUMERICAL RESULT

BACKGROUND OF THE INVENTION

The present invention relates to casino games and gaming formats and, more particularly, to betting options and modified versions of existing games where a result is determined according to numerical values.

Baccarat is played internationally with different rules and different names, such as Punto Banco and Chemin-de-Fer. In the U.S., Baccarat is typically played in a dedicated VIP high-stakes gaming area. In an effort to increase the popularity of the game, smaller versions of Baccarat such as Mini-Baccarat have been introduced in the regular gaming area.

There are several drawbacks associated with conventional Baccarat. In particular, in certain situations, the house takes a commission on wagers. Although the house needs an advantage, the use of commission can deter many players. Moreover, from a casino perspective, calculating commissions slows down the game. To correct this, the game may be operated where the commission is collected not after each hand, but at the end of each shoe (a shoe holds multiple decks of cards from which hands are dealt by the dealer), prior to reshuffling the decks. While this speeds up the game, collection of commission may be impacted by the player running out of funds or not wishing to meet the obligation.

Moreover, for novice players, the rules of play seem obscure, and the procedure is prone to error. In Baccarat, there is a player hand and a banker hand, but the casino player may bet either hand. Each hand receives two cards with 10's and face cards counting as zero. The superior hand is the higher hand, with 9 being the highest total and with each hand being allowed to draw a third card in certain circumstances. The card draw option to the player hand is determined by the player two-card total, and the card draw option to the banker hand is determined by the banker two-card total and the exact third card drawn by the player. With these rules, although the game is simple in its concepts, the game has a complicated appearance.

Still further, with conventional Baccarat, there is an inherent hand-value deterioration bias. That is, a two-card total of 5 improves with a 1, 2, 3 or 4 value card, but deteriorates with a 5, 6, 7, 8 or 9 value card, which creates the inherent bias.

Additionally, except for a tie offering payoff odds of 8 to 1, conventional Baccarat does not present any opportunity to win above even money. Notwithstanding, many players perceive the odds for a tie bet to be unfair. Also, as the tie is a push, there is no casino advantage working on the player and banker wagers when a tie occurs. If the tie outcome could be incorporated into the outcome of the basic wager, then either the house could enjoy an increased advantage, or a lower advantage on the primary wagers would be viable.

In one modified version of Baccarat, so called Bahama Baccarat or No Commission Baccarat, the commission aspect has been successfully removed. The house advantage is incorporated in a bar rule so a specific result is determined differently than with conventional Baccarat. In this context, however, the game retains a complicated draw process, does not offer higher payoffs, the tie is a non-result, and the bar rule gives an impression of a lack of balance.

SUMMARY OF THE INVENTION

There is thus a need for a Baccarat variant that not only removes the commission aspect of the game, but also eliminates card drawing complications, incorporates a house advantage in the tie result, offers additional wager options with high odds payoffs, and removes the inherent deterioration bias in conventional Baccarat. With such a Baccarat variant, the game would be simple to operate and attractive to new players.

According to the present invention, a Baccarat variant incorporates a number of betting options in addition to the standard player hand win or banker hand win option. For example, additional wagering options may include a "win by" option corresponding to an amount by which one hand beats the other or a "tie with" option corresponding to a particular total that both hands will be dealt. The methodology according to the invention can be applied to other numerical value games such as Blackjack, War, Dice or an original numerical game.

According to a particular aspect of the invention, there is provided a method of playing a game where a result is determined according to numerical values. The method includes (a) receiving at least one wager that at least one of a plurality of events will occur. The plurality of events include at least two of (1) a first side having a higher numerical value than a second side, (2) the first side having a higher numerical value than the second side by a prescribed amount, (3) the first side having a numerical value equal to the second side, and (4) the first side having a particular numerical value equal to the second side. The method further includes (b) playing the game such that the first side and the second side each obtains results of a numerical value, and (c) resolving the at least one wager according to the numerical value results. According to the rules of the game, the player can wager on either the first side or the second side. Step (b) may be practiced by dealing one or more playing cards to each of the first side and the second side. Playing cards having an indicia of a King, a Queen, or a Jack are preferably assigned a value of zero. Alternatively, prior to step (a), the deck or decks may be prepared by removing cards having an indicia of a King, a Queen, or a Jack.

Step (b) may be practiced by dealing two playing cards to each of the first side and the second side and determining a numerical total of each of the two playing cards according to predetermined rules of the game. Subsequently, one of the first side and the second side having a higher numerical total is declared to be the winner. Step (c) is preferably practiced by paying 1 to 1 for wagers on event (1) and paying an amount higher than 1 to 1 such as 18 to 1 for wagers on event (2). Step (c) may be further practiced by paying 90 to 1 for wagers on event (4). Values of 10 may be counted as zero, and thus the one of the first side and the second side having a numerical total that is closer to 9 is declared to be the winner. Step (c) may be practiced by collecting wagers on event (1) when the first side numerical total has a particular numerical value equal to the second side numerical total. Alternatively, step (c) may be practiced by pushing wagers on event (1) when the first side numerical total has a numerical value equal to the second side numerical total.

Step (b) may be practiced according to the rules of Baccarat, Blackjack or War. Additionally, step (b) may be practiced using one or more dice for each of the first side and the second side.

In accordance with another aspect of the invention, there is provided an apparatus configured for playing a game including a display, a player interface for receiving player input, and a processor configured to effect game play. The processor enables the method according to the invention.

In accordance with yet another aspect of the invention, there is provided an apparatus configured for playing a game including a display, a player interface, and a controller receiving input from the player interface and including circuitry for effecting game play. The apparatus includes a betting unit forming part of the player interface that receives at least one wager that at least one of a plurality of events will occur. The plurality of events include at least two of (1) a first side having a higher numerical value than a second side, (2) the first side having a higher numerical value than the second side by a prescribed amount, (3) the first side having a numerical value equal to the second side, and (4) the first side having a particular numerical value equal to the second side. The apparatus further includes a processing circuit that effects play of the game such that the first side and the second side each obtains results of a numerical value. The processing circuit then resolves the at least one wager according to the numerical value results.

In accordance with still another aspect of the invention, there is provided a game where a result is determined according to numerical values. The game includes a game table including a plurality of betting areas corresponding to a plurality of events. The plurality of events includes at least two of the events listed above. The game also includes game equipment for establishing results of the first side numerical value and the second side numerical value. The game equipment preferably includes one or more standard decks of playing cards. Playing cards having an indicia of a King, a Queen or a Jack may be removed from the decks. The game equipment may alternatively include dice. The game table preferably additionally includes a rules area setting forth rules of the game.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
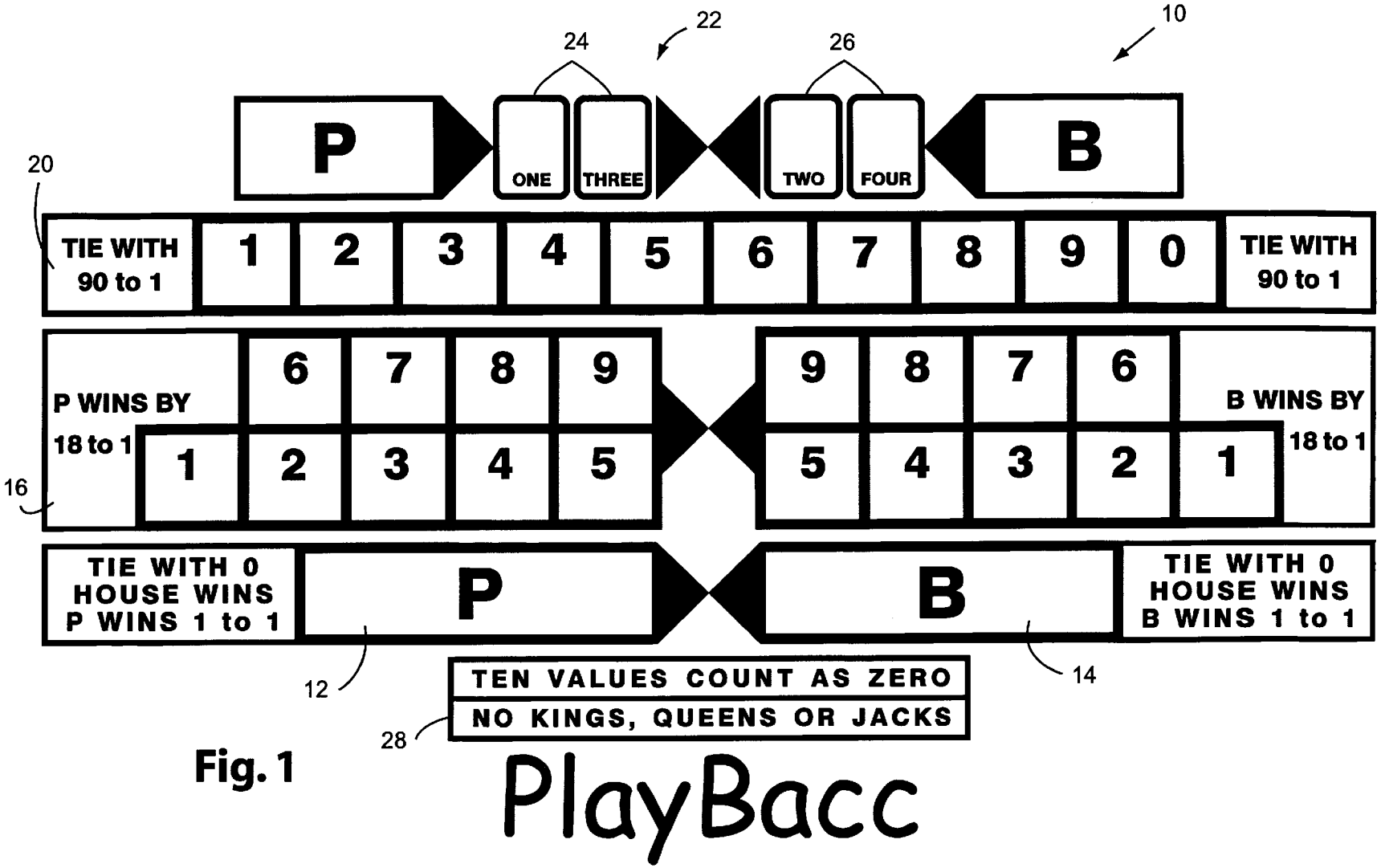
FIG. 1 is a plan view of a table arrangement according to the present invention.

FIG. 1 illustrates a playing surface or table layout 10 on which an embodiment of the invention may be played. The game according to the invention is preferably played on a rectangular-shaped table including a host or dealer and game equipment for establishing results for a first side such as a player designated "P" and a second side such as a banker designated "B." In conventional Baccarat, one hand is designated as a player hand, and the other hand is designated as a banker hand. Participants in the game, however, can bet either for the player hand or the banker hand, which is the source of some confusion. To eliminate this confusion, according to the invention, the hands are referred to as a first side and a second side or as "P" and "B."

As shown in FIG. 1, the preferred layout includes multiple betting a 12, 14, 16, 18 and 20 for one or a plurality of players. The betting areas include competition wager areas 12, 14 for simple bets that either the first side will win the hand or the second side will win the hand. Three proposition wager areas 16, 18 and 20 are referred to as "P wins by," "B wins by" and "tie with", respectively. The layout 10 also includes a dealer area 22 having two hand areas 24, 26 for the first side hand and the second side hand, respectively, and a rules area 28 setting forth one or more rules of the game.

In the preferred embodiment, the game equipment includes one or more standard decks of playing cards with or without picture cards being removed. In a standard deck of playing cards, picture cards include playing cards having an indicia of a King, a Queen or a Jack. The deck used in the game may be a conventional collection of multiple packs of 52 cards or more preferably a deck of 10 packs of 40 cards each with the picture cards removed. Similar to conventional Baccarat, aces count as 1, 10 cards count as zero, and 10 values in totals (e.g., a 3 card and a 7 card in a two-card hand) also count as zero. The advantage of the deck without picture cards is that the bias toward zero totals is removed, thus minimizing the value of player card-counting skills. Whichever deck is used, each hand may be a two-card or three-card hand depending on the version in operation. Once the hands are dealt, there is no draw of cards thus eliminating errors, confusion and the inherent hand-deterioration bias. In a preferred embodiment, each side receives two cards, one each in alternating order.

Each player may place a bet for either side in the competition wager area 12, 14 and also may make proposition bets in the proposition wager areas 16, 18 and 20. Although any rules concerning hand totals and the like can be adopted, the preferred rules for determining the winning hand preferably correspond with the rules of conventional Baccarat. That is, the hand having a numerical total closest to 9 is the winner.

The competition wager in areas 12 and 14 is a wager that one side or the other will win the game-and preferably pays 1 to 1. A house advantage can be created with this bet for situations where the first side hand numerical total is equal to the second side hand numerical total. For example, all tied hands typically result in a pushed wager except for a tie on one or more specific numbers such as zero in which the house wins. With regular decks, zero ties may be determined as ties, losses or wins dependent upon whether the zero totals included 10-value cards. Alternatively, all P and B bets may win when the tie is on any of a set of numbers, whereas all P and B bets lose when the tie is on any of an alternative set of numbers, with an option for any specific numbers such as zero to be a tie. The house advantage changes with different sets of numbers, so a variety of sets with alternative sets may be viable. For example, all bets in the competition wager areas 12, 14 may be paid 1 to 1 when the hands tie with a numerical total of 2, 4, 6 or 8, and all bets lose on a tie with a numerical total of 1, 5,7 or 9, and all bets push on a tie with zero. In another variation, the groups could be 1, 2, 3, 4 and 5, 6, 7, 8, 9, respectively. Of course, many alternatives can be contemplated in this scenario.

In the "wins by" proposition areas 16, 18, a player may wager on one side or the other winning a hand by a certain amount. This winning wager pays an amount higher than 1 to 1 such as 18 to 1, for example. Finally, in the proposition wager area 20, a player can wager that the first side hand and the second side hand will tie with a particular total. A winning wager in this area 20 will also pay higher than 1 to 1, and preferably as high as 90 to 1. Of course, an additional proposition wager could encompass ties not at a particular number.

In playing the game, the dealer preferably deals a first card to each hand area 24, 26 and then a second card to each area. The dealer then determines a numerical total and resolves the wagers according to the results of the game.

The game according to the invention is applicable to any game where a result is determined according to numerical values, such as Blackjack, War, Dice or an original numerical game. In the dice version of the game, of course, the game equipment for establishing results of the first side numerical value and the second side numerical value includes one or more dice.

As would be apparent to those skilled in the relevant art, the invention can be embodied in a wide variety and forms of media, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
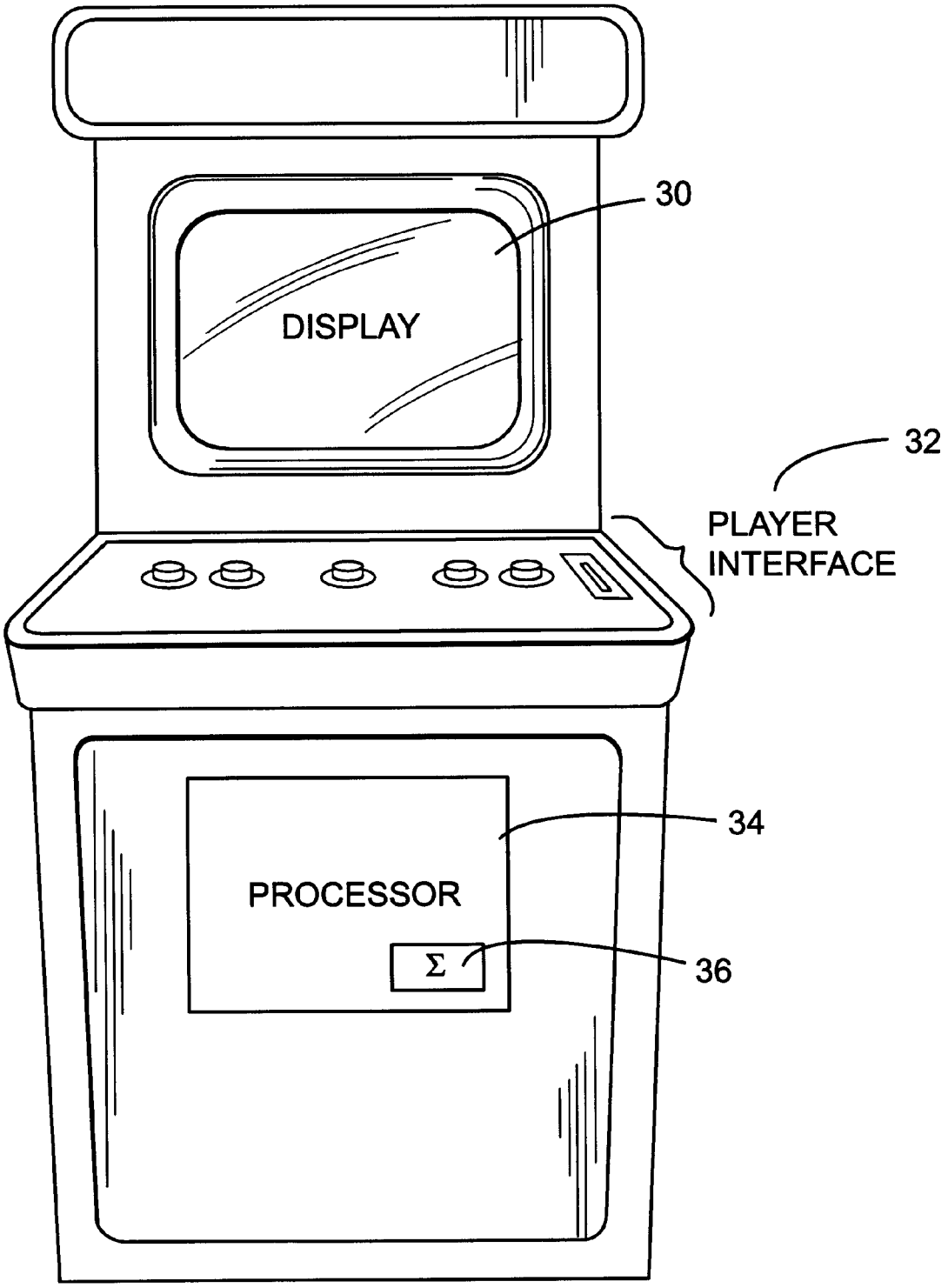
FIG. 2 is a schematic diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34, 36 for effecting game play and including structure for establishing first side and second side numerical value results, such as dealing hands of cards, a summing circuit 36 that determines a numerical value of the results, and a processing circuit 34 effecting game play according to the rules of the game. The processing circuit then resolves wagers according to the numerical value results.

With the methodology according to the present invention, drawbacks associated with conventional Baccarat and the like can be eliminated, resulting in a more enjoyable and playable game that is suited for players of all levels. The multiple betting options adds excitement to the game, and elimination of card drawing rules increases the speed of play, eliminates player confusion, and avoids an inherent deterioration bias.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a game where a result is determined according to numerical values, the method comprising:

(a) receiving at least one wager that at least one of a plurality of events will occur, the plurality of events including at least two of (1) a first side having a higher numerical value than a second side, (2) the first side having a higher numerical value than the second side by a prescribed amount, (3) the first side having a numerical value equal to the second side, and (4) the first side having a particular numerical value equal to the second side;

(b) playing the game such that the first side and the second side each obtains results of a numerical value;

(c) determining a game result according to the numerical value results; and (d) resolving the at least one wager according to the game result and the numerical value results, wherein a wager for event (1) is resolved differently for a same game result with different numerical value results.

2. A method according to claim 1, wherein a player can wager on either the first side or the second side.

3. A method according to claim 1, wherein step (b) is practiced by dealing one or more playing cards to each of the first side and the second side.

4. A method according to claim 3, further comprising assigning playing cards having an indicia of a King, a Queen or a Jack a value of zero.

5. A method according to claim 3, further comprising, prior to step (a), preparing a deck of the playing cards by removing cards having an indicia of a King, a Queen or a Jack.

6. A method according to claim 3, wherein step (b) is practiced by dealing two playing cards to each of the first side and the second side and determining a numerical total of each of the two playing cards according to predetermined rules of the game.

7. A method according to claim 6, further comprising declaring one of the first side and the second side having a higher numerical total to be the winner.

8. A method according to claim 7, wherein step (d) is practiced by paying 1 to 1 for wagers on event (1) and paying an amount higher than 1 to 1 for wagers on event (2).

9. A method according to claim 8, wherein step (d) is practiced by paying 18 to 1 for wagers on event (2).

10. A method according to claim 6, wherein step (d) is practiced by paying 90 to 1 for wagers on event (4).

11. A method according to claim 6, further comprising counting values of ten as zero, and declaring one of the first side and the second side having a numerical total that is closer to nine to be the winner.

12. A method according to claim 6, wherein step (d) is practiced by collecting wagers on event (1) when the first side numerical total has a particular numerical value equal to the second side numerical total.

13. A method according to claim 6, wherein step (d) is practiced by pushing wagers on event (1) when the first side numerical total has a numerical value equal to the second side numerical total.

14. A method according to claim 1, wherein step (b) is practiced according to rules of Baccarat.

15. A method according to claim 1, wherein step (b) is practiced according to rules of Blackjack.

16. A method according to claim 1, wherein step (b) is practiced according to rules of War.

17. A method according to claim 1, wherein step (b) is practiced using one or more dice for each of the first side and the second side.

* * * * *